United States Patent [19]

Kwasuik et al.

[11] Patent Number: 4,673,463

[45] Date of Patent: Jun. 16, 1987

[54] METHOD FOR EXTRACTING CHARGING GASES IN COKE OVEN CHAMBERS

[75] Inventors: Hans-Jurgen Kwasuik, Herne; Hans-Gunter Piduch, Bochum, both of Fed. Rep. of Germany

[73] Assignee: C. Otto & Comp. G.m.b.H., Bochum, Fed. Rep. of Germany

[21] Appl. No.: 825,864

[22] Filed: Feb. 4, 1986

Related U.S. Application Data

[63] Continuation of Ser. No. 643,495, Aug. 23, 1984, abandoned.

[30] Foreign Application Priority Data

Sep. 3, 1983 [DE] Fed. Rep. of Germany ..... 3331849

[51] Int. Cl.[4] ..... C10B 57/00; C10B 27/04

[52] U.S. Cl. ..... 201/41; 202/263

[58] Field of Search ..... 202/250, 254, 261, 263, 202/269, 241, 255, 256, 257; 414/162, 163, 164; 201/41

[56] References Cited

U.S. PATENT DOCUMENTS

| | | | |
|---|---|---|---|
| 3,791,320 | 2/1974 | Gidick | 202/263 |
| 4,314,889 | 2/1982 | Kwasnik et al. | 202/263 |
| 4,465,557 | 8/1984 | Blase et al. | 202/263 |

FOREIGN PATENT DOCUMENTS

| | | | |
|---|---|---|---|
| 1105380 | 4/1961 | Fed. Rep. of Germany | 202/263 |
| 3204991 | 2/1982 | Fed. Rep. of Germany | 202/263 |

*Primary Examiner*—Peter Kratz

*Attorney, Agent, or Firm*—Thomas H. Murray; Clifford A. Poff

[57] ABSTRACT

Method for exhausting from coke ovens gases evolved during charging with the use of a conduit interconnecting an opening in the roof of a coke oven chamber being charged with a corresponding opening in a nearby oven. According to the inveniton, near one of the ends of the conduit interconnecting the two ovens a communication with the atmosphere can be made without disturbing the gas-tight connection between the other end and the nearby oven. One way of achieving this is for the sealing zone or closure portion which dips into a water seal in a riser for a coke oven chamber to be shorter than the other end such that when the conduit is raised the shorter end will permit atmospheric air to flow into the conduit. In another embodiment, a socket is provided at one end of the conduit and has a pivoting flap which, in one position, closes the socket and in another position, closes the gas-exhaust opening. Another embodiment of the invention employs a sleeve in which a tubular member having a bottom sealing zone or closure portion is movable, such portion dipping into a water seal when lowered and clearing the water seal when raised. Still another embodiment of the invention employs internal cover lifters.

13 Claims, 8 Drawing Figures

METHOD FOR EXTRACTING CHARGING GASES IN COKE OVEN CHAMBERS

Figure 1A:
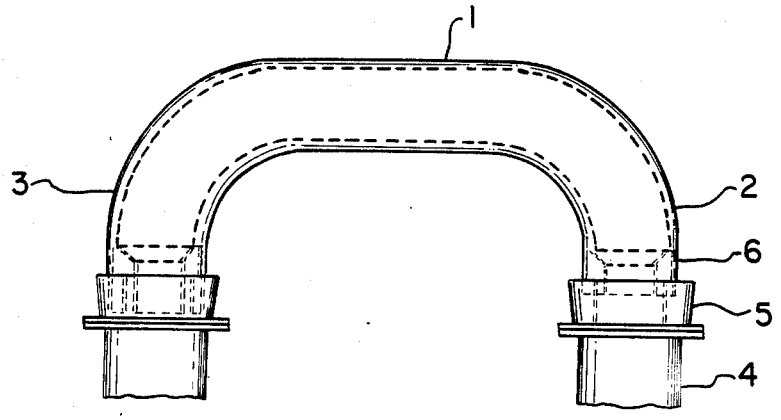

This is a continuation of co-pending application Ser. No. 643,495 filed on Aug. 23, 1984, now abandoned.

BACKGROUND OF THE INVENTION

The present invention relates to apparatus for extracting charging gases through an orifice in the roof of one coke oven chamber and for discharging the gases to an adjacent, second coke oven chamber through openings in the roofs of the respective chambers. In the usual case, gases extracted from the first chamber are discharged into a second chamber which is separated from the first by an intermediate chamber.

More particularly, the invention relates to apparatus including a generally U-shaped pipe or conduit, disposed for vertical movement on a truck movable along the top of a coke oven battery, the pipe having downwardly-extending end portions each having an annular sealing end which dips into a water seal provided in a riser surrounding an opening in the roof of the coke oven chamber. The risers are normally closable by covers. While coking proceeds in one oven chamber, the suction applied by the gas-collecting main of the battery is adjusted to draw the charging gases through the conduit or pipe from the other coking chamber while it is being charged. In this manner, a large portion of the charging gases and dust evolved during charging of an oven chamber can be extracted and discharged into another chamber where coking is proceeding.

Apparatus of this type for extracting charging gases is shown, for example, in U.S. Pat. No. 4,314,889, issued Feb. 9, 1982. In the apparatus shown in that patent, gases are extracted from one coke oven chamber and discharged into another by initially removing the covers from the risers, whereupon the aforesaid conduit is lowered onto the openings in the furnace roof and into water seals provided in the risers so that a gas-tight closure is provided. If the suction from the nearby chamber is increased, some of the gases being evolved from the chamber being charged flow through the conduit. Upon completion of charging, the conduit is raised and the covers again secured to the risers.

In an operation of the type described above, explosions often occur when the conduit is lifted from the risers, the explosions occurring not only with water-sealed transfer conduits but also with transfer conduits having other forms of seals. The reason for the explosions is that when the conduit is lifted, residual gases combine with oxygen to form an explosive mixture which ignites at the high temperatures present.

SUMMARY OF THE INVENTION

In accordance with the present invention, a new and improved method for extracting charging gases from a coke oven chamber are provided wherein the gases are extracted from a chamber being charged and discharged into an adjacent oven, but wherein possible explosions are obviated. This is accomplished by providing near one of the ends of the transfer conduit, preferably near the end connected to the oven being charged, a communication with the atmosphere without disturbing the gas-tight connection between the other end and the nearby operating oven chamber.

In one embodiment of the invention, communication with the atmosphere is provided at one end of the conduit in an arrangement wherein the end of the conduit which dips into the water seal on a riser is shorter than at the other end so that when the conduit rises on the truck on which it is carried, the water-seal closure associated with the shorter end is broken; whereas the other end still remains immersed in the water seal. This permits atmospheric air to flow into the conduit through its shorter end.

In accordance with another embodiment of the invention, a connecting socket is provided above the sealing zone at one end of the conduit and has a pivoted flap which, in one position, closes the socket and permits the gases evolved in charging to enter the conduit and be discharged into an adjacent coke oven chamber. In the other position of the flap, the socket is open to the atmosphere. Instead of a socket, a sleeve can be used instead of one of the elbows of the conduit and a tubular member can be caused to move vertically in the sleeve, the tubular member being closed at the top and having at its bottom end a sealing zone which, in the lowered position, dips into the water seal on the riser and in the raised position is clear of the water seal.

It is also possible to have an internal cover lifter within the transfer conduit. In this embodiment of the invention, a domed cover can be moved vertically in each of the two downwardly-depending legs of the conduit and can be moved vertically by means of an actuating rod from a top position. In the top position, the cover closes a top opening in the conduit; and in its bottom position, the cover dips into a second, inner water seal disposed concentrically with respect to the water seal into which the end of the conduit extends. In this case, the domed cover is releasably connected to the actuating rod so as to be able to form the cover for a riser when the conduit is lifted upwardly.

The procedure according to the invention obviates explosions since the suction in the conduit and the associated high-flow velocity therein prevent ignition of the gas and air mixture.

Figure 1B:
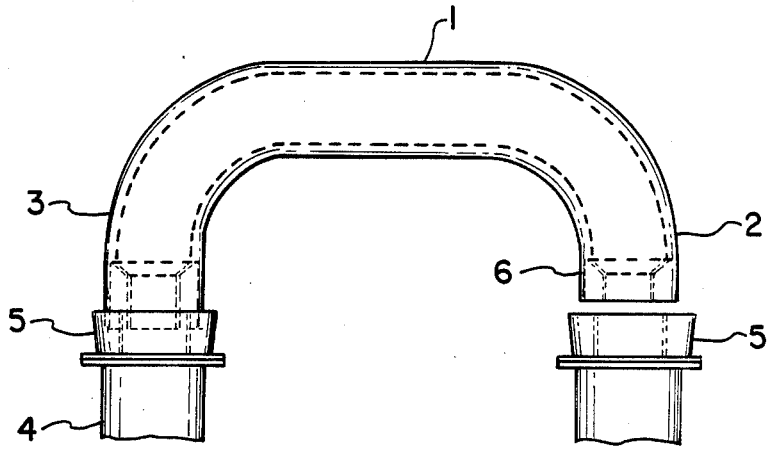
Figure 2A:
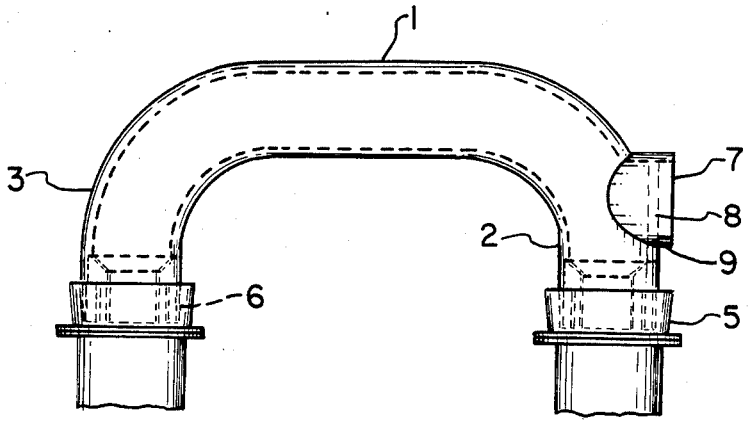
Figure 2B:
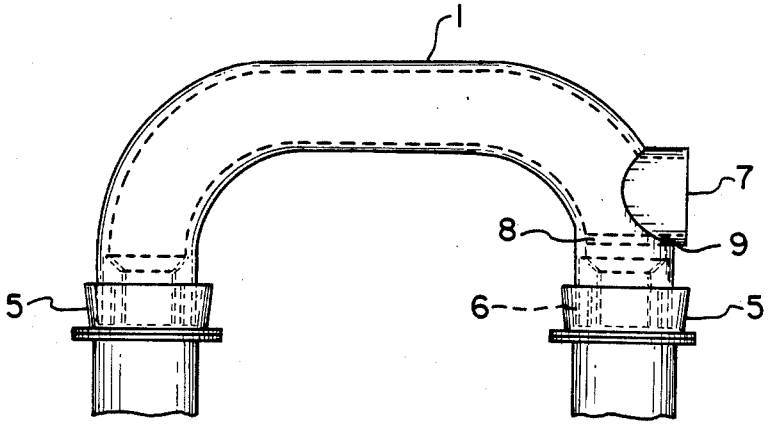
Figure 3A:
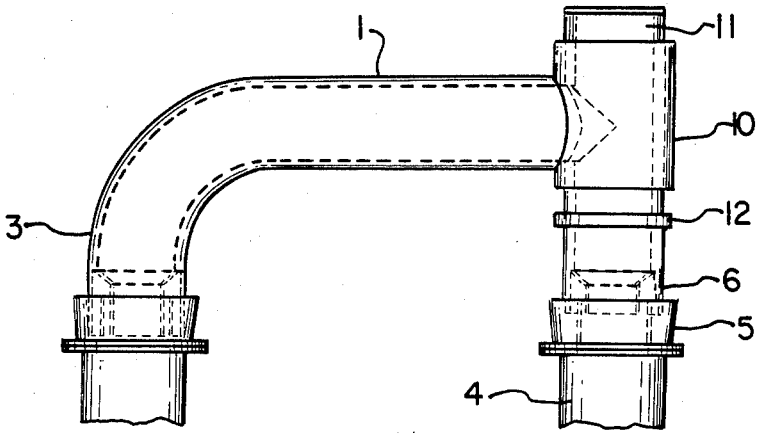
Figure 3B:
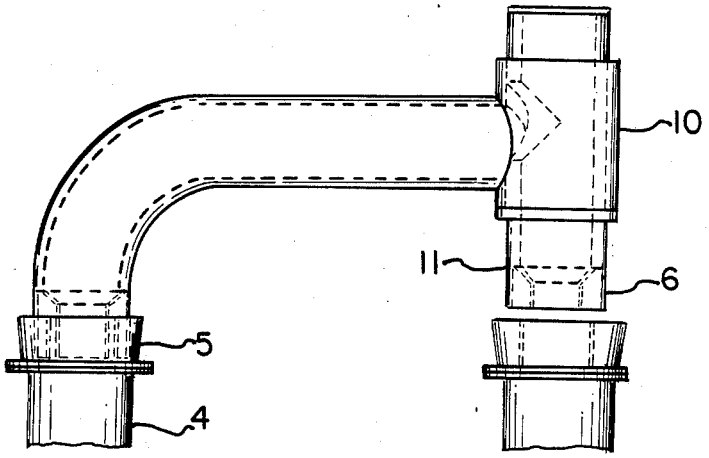
Figure 4A:
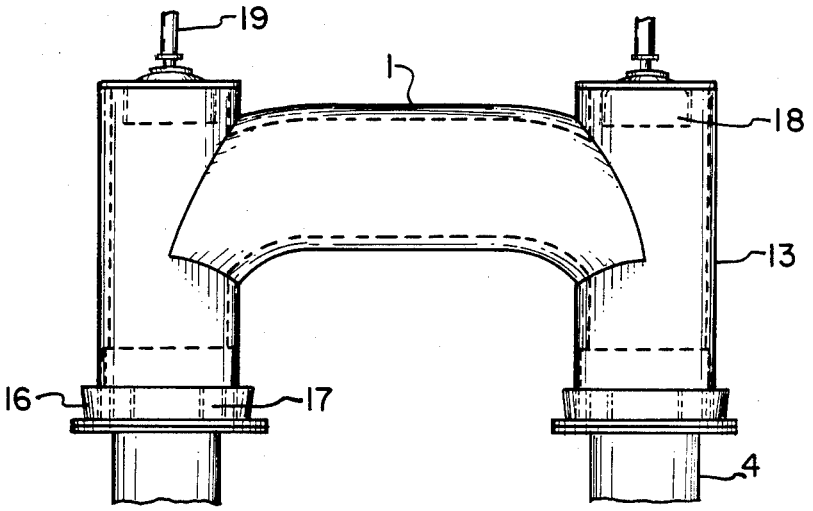
Figure 4B:
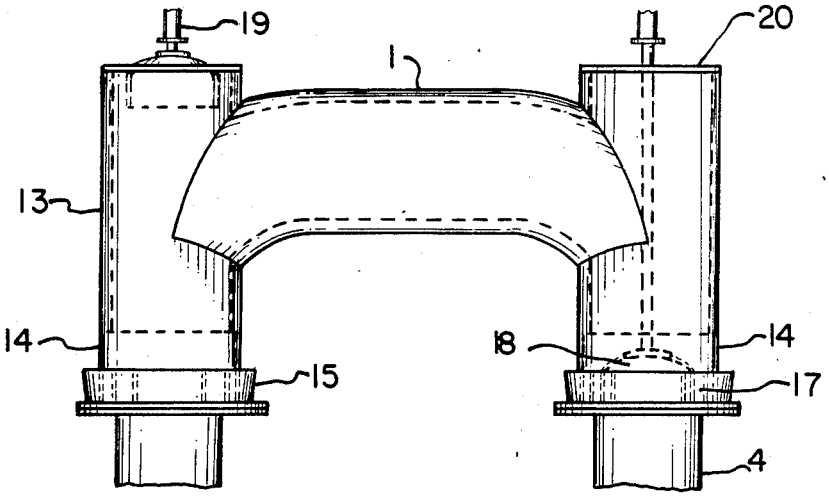

The above and other objects and features of the invention will become apparent from the following detailed description taken in connection with the accompanying drawings which form a part of this specification, and in which:

FIGS. 1*a* and 1*b* are elevational views in the operative position and scavenging position, respectively, of an embodiment of the transfer conduit of the invention having one end shortened with respect to the other;

FIGS. 2*a* and 2*b* are plan views in the operative and scavenging positions, respectively, of another embodiment of the invention having a closure flap;

FIGS. 3*a* and 3*b* are elevational views, in the operative position and scavenging position, respectively, of a third embodiment of the invention having a vertically-movable conduit section which moves within a sleeve; and FIGS. 4*a* and 4*b* are plan views, in the operative and scavenging positions, respectively, of a fourth embodiment of the invention having an internal riser-cover lifter.

With reference now to the drawings, and particularly to FIGS. 1*a* and 1*b*, a transfer conduit 1 is shown in the form of a U-shaped tubular member having ends 2 and 3 in the form of elbows. Each end 2 or 3 is connected to a respective open chamber, one chamber being charged while the other chamber, usually the chamber on the other side of the immediately adjacent chamber, contains coke which has been wholly or partly carbonized.

Risers 4 are received in the roof openings of the oven chambers, not shown. The riser top ends are each provided with an annular water seal 5 as is conventional. The water seals can be closed by outwardly-pivoting covers, not shown. In the operative position shown in FIG. 1*a*, some of the gases evolved in charging can be sucked into the oven chamber containing the carbonized coke after increasing the suction in the gas-collecting main for the battery. To this extent, the operation corresponds to the gas-exhausting system disclosed by the aforesaid U.S. Pat. No. 4,314,889.

In order to obviate the risk of explosion when the conduit 1 is raised upwardly from the seals 5, a communication with the atmosphere is provided at one end of the U-shaped conduit, preferably at the end extending into the oven being charged. This occurs upon completion of charging without disturbing the gas-tight connection between the other end of the conduit 1 and the oven chamber which is in operation, so that scavenging air is sucked into the conduit from the atmosphere and through the conduit to the chamber in operation. To this end, and in the embodiment shown in FIGS. 1*a* and 1*b*, the closure portion or sealing zone 6 which dips into the water seal 5 is shorter at the right end of the conduit than at the other end. Consequently, the conduit can be moved upwardly a short distance from the operative position shown in FIG. 1*a* into the scavenging position shown in FIG. 1*b* wherein the conduit end on the right having the shorter sealing zone or closure portion 6 has emerged from the water seal 5; whereas the gas-tight seal is still in effect at the other end 3 of the conduit. Scavenging air thus enters the resulting gap between the right end 2 and the seal 5 as indicated by the arrow in FIG. 1*b* and flows through the conduit 1 to end 3 where it is discharged through the chamber containing the carbonized coke.

In the embodiment of the invention shown in FIGS. 2*a* and 2*b*, the closure portions or sealing zones 6 are of the same length at both ends and dip into the water seals 5 to the same depth. Disposed above the portion 6 at conduit end 2 is a socket 7 closable by means of a flap 8 pivotal around a horizontal pivot 9. FIG. 2*a* shows the operative position in which the flap 8 closes the opening of socket 7 to enable the gases evolved in charging to be sucked freely through the conduit 1 to the adjacent coke oven chamber. In the scavenging position shown in FIG. 2*b*, the horizontal flap 8 closes the riser and opens the socket 7 such that atmospheric air can flow into the conduit 1.

In the embodiment shown in FIGS. 3*a* and 3*b*, a sleeve 10 is used instead of one of the elbows of the conduit 1. A tubular member 11 is adapted to move vertically within the sleeve 10. An opening in the side of member 11, within sleeve 10 communicates with conduit 1. The member 11 is closed at its top and has at its bottom end an annular sealing zone or closure portion 6 which, with the member 11 in the lowered operative position shown in FIG. 3*a*, dips into the water seal 5. When the member 11 is in the raised position shown in FIG. 3*b*, which is limited by an annular abutment 12 of the member 11, the sealing zone 6 is above the water seal 5 so that scavenging air can be sucked through the resulting gap, member 11 and through the conduit 1.

FIGS. 4*a* and 4*b* show an embodiment of the invention having an internal cover lifter. In this embodiment, vertical tubular members 13 are used instead of the conduit elbows and each have at their bottom end an annular sealing zone or closure portion 14 which dips into an outer water seal 16 of a double-water seal closure 15 extending concentrically around an inner annular water seal 17. A domed cover 18 is disposed in each of the two vertical tubular members 13 and can move from an upper position, in which it closes a top opening 20 in the member 13, to a bottom position in which its bottom end dips into the inner seal 17 with the top opening 20 of the tubular member 13 being open. Preferably, the cover 18 is actuated by means of an actuating rod 19 to which the cover 18 is releasably secured so that the rod 19 can be separated from the cover 18 when the latter is in the water seal (right-hand half of FIG. 4*b*). In this manner, the cover 18 forms the seal for closing the riser 4.

FIG. 4*a* shows the operative position of the conduit in which the gases evolved during charging are sucked from one oven chamber to another through the tubular members 13 and the central portion of the conduit 1; whereas FIG. 4*b* shows the scavenging position wherein the right-hand cover 18 closes the corresponding riser and air can enter through the top opening 20 of the right-hand tubular member 13.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. A method for exhausting from coke ovens gases and dust evolved during charging, comprising the steps of placing one end of a generally U-shaped conduit in an opening in the roof of a first oven to be charged, placing the other end of the U-shaped conduit in an opening in the roof of a second nearby oven, providing seals around said roof openings whereby said opposite ends of the U-shaped conduit extend into and are sealed gas-tight by said seals, charging coal into said first oven while permitting gases to flow from the first oven to the second oven through said conduit, and after charging has been completed providing a communication between the one end of the conduit and the atmosphere without disturbing the gas-tight seal between the other end of the conduit and its associated oven in a manner such that ignition of gas and air in the conduit is avoided by a high gas flow velocity therewithin, thus preventing explosions of residual gas within the conduit while lifting said ends from their associated roof openings thereafter.

2. The method according to claim 1 wherein the U-shaped conduit defines a first elbow and a second elbow at the ends thereof, said first elbow of a length less than that of said second elbow.

3. The method according to claim 2 wherein during the step of charging, both said first and second elbows, respectively, extend into said seal associated therewith to allow gases to flow from the first oven to the second oven.

4. The method according to claim 2 wherein the step of providing a communication between the one end of the conduit and the atmosphere includes moving upwardly the U-shaped conduit such that said first elbow is out of contact with the seal associated therewith thereby creating a gap therebetween, allowing atmospheric air to flow to the second oven through said gap.

5. The method according to claim 1 wherein the U-shaped conduit defines a first elbow and a second elbow, said first elbow including a socket and closable flap therealong with said closable flap pivotal about a pivot.

6. The method according to claim 5 wherein during the step of charging, said closable flap is pivoted into a closed position to close said socket, and both said first and second elbows, respectively, extend into said seals to allow gases to flow from the first oven to the second oven.

7. The method according to claim 5 wherein the step of providing a communication between the one end of the conduit and the atmosphere includes pivoting said closable flap about said pivot to open said socket and to block the end of said first elbow to allow atmospheric air to flow to the second oven.

8. The method according to claim 1 wherein the U-shaped conduit includes a vertically along positional sleeve one end thereof and an elbow along the other end thereof, said sleeve containing a slidable tubular member therewithin, said tubular member closed at the top end thereof and containing an opening along the side thereof to provide a passageway between said sleeve and said elbow.

9. The method according to claim 8 wherein during the step of charging, said tubular member is lowered such that the lower end thereof extends into the seal associated therewith and said opening allows gases to flow from the first oven to the second oven through said gap.

10. The method according to claim 8 wherein the step of providing a communication between the one end of the conduit and the atmosphere includes moving upwardly the tubular member such that the lower end thereof is out of contact with the seal associated therewith thereby creating a gap therebetween, allowing atmospheric air to flow to the second oven.

11. The method according to claim 1 wherein the U-shaped conduit connects to a first tubular member at the one end thereof and a second tubular member at the other end thereof, each tubular member containing a top opening and a bottom opening, respectively, and each tubular member having a domed cover therewith capable of moving from an upper position in which the cover closes the top opening to a lower position in which the cover extends into the seal associated therewith.

12. The method according to claim 11 wherein during the steps of charging, each of said domed covers are in the upper position.

13. The method according to claim 11 wherein the step of providing a communication between the one end of the conduit and the atmosphere includes moving the domed cover of the first tubular member to the lower position, thereby allowing atmospheric air to flow through the top opening thereof to the second oven.

* * * * *